United States Patent [19]

Volle

[11] 4,343,211

[45] Aug. 10, 1982

[54] JET CUTTER HAVING SUPPLY HOSE WOUND ON A DRUM

[75] Inventor: Frode I. Volle, Nesoya, Norway

[73] Assignee: Thune-Eureka A/S, Tranby, Norway

[21] Appl. No.: 212,257

[22] Filed: Dec. 2, 1980

[30] Foreign Application Priority Data

Dec. 13, 1979 [NO] Norway ..... 794076

[51] Int. Cl.[3] ..... B26F 1/26

[52] U.S. Cl. ..... 83/177; 239/195; 242/86

[58] Field of Search ..... 83/53, 177, 353; 239/195–199; 242/86–86.4; 137/355.16–355.27

[56] References Cited

U.S. PATENT DOCUMENTS 3,088,355 5/1963 Hornbostel, Jr. ..... 83/177

3,625,813 12/1971 Eckelman ..... 83/177 X

*Primary Examiner*—James M. Meister

*Attorney, Agent, or Firm*—Young & Thompson

[57] ABSTRACT

A cut squirt wherein a nozzle for a jet of cutting liquid is movably supported on a boom extending transversely of the direction of advancement for a web of paper and is connected to a supply hose for cutting liquid which is coiled in one layer on a driven drum and is connected at the drum to a feed conduit for said liquid, whereby the nozzle is driven back and forth along the boom when the hose is uncoiled from or coiled onto the drum. The drum end of the hose is attached to a carrier which rotates together with the drum and has cam engagement with a fixed guide member such that the carrier is displaced one hose width in the axial direction of the drum for each revolution of the drum, and in that a flexible, liquid-conduit connection is arranged between the drum end of the hose and the cutting liquid feed conduit to the drum.

6 Claims, 4 Drawing Figures

JET CUTTER HAVING SUPPLY HOSE WOUND ON A DRUM

The present invention relates to a cut squirt wherein a nozzle for a jet of cutting liquid is movably supported on a boom extending transversely of the direction of advancement for a paper web and is connected to a supply hose for the cutting liquid which is coiled in one layer on a driven drum and is connected at the drum to a feed conduit for the cutting liquid, whereby the nozzle is driven back and forth along the boom as the hose is wound off or coiled onto the drum, respectively.

The cut squirt is used for cutting the paper web in order to provide a leading tip for introduction of the web onto a roll. A jet of liquid is used to cut the web, usually water under pressure which is sprayed down onto the web in a cutting jet. Supported in a boom which extends transversely of the web is a carriage from which the jet nozzle is suspended. A hose passes from the nozzle at the carriage, along the boom, to a driven drum on one side of the paper-making machine, where the hose can be wound onto or wound off the drum. As the hose is being coiled onto or wound off the drum, the carriage with its associated jet nozzle will move transversely of the paper web.

This known apparatus works very satisfactorily, but for larger-width webs, i.e., of 6 meters or more, the hose may be subjected to such large bending stresses that it becomes permanently deformed or cracked. This occurs because as the hose is being unwound and travels out along the boom, its deflection increases steadily in a direction toward the swivel end of the drum, i.e., where the water is supplied via a feed conduit extending radially outward from the central swivel to the drum casing. This deflection increases with increasing length of unwound hose, and can under unfavourable circumstances become so great that the hose is subjected to permanent deformation or becomes cracked. It is the aim of the present invention to remedy this problem, and this is achieved according to the invention in that the point of entry/exit for the hose on the drum is held at least substantially aligned with the hose extending out along the boom, such that one prevents the above-discussed bending of the hose when it is being coiled onto or wound off the drum.

According to the invention, therefore, a cut squirt as defined above is provided, which is characterized in that the drum end of the hose is attached to a carrier which rotates along with the drum and has cam engagement with a fixed guide member such that the carrier moves one hose-width in the axial direction of the drum for each revolution of the drum, and in that a flexible, liquid-conduit connection is provided between the drum end of the hose and the feed conduit for the cutting liquid at the drum.

Further features of the cut squirt will be recited in the subclaims, and in the following description of embodiment examples of the invention, the advantages of the features emphasized in the claims will become apparent.

Figure 1:
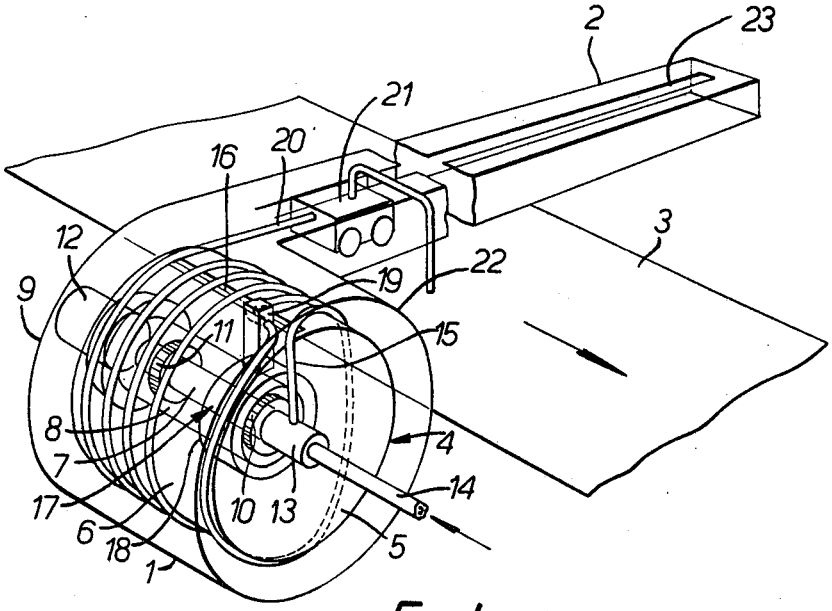
Figure 2:
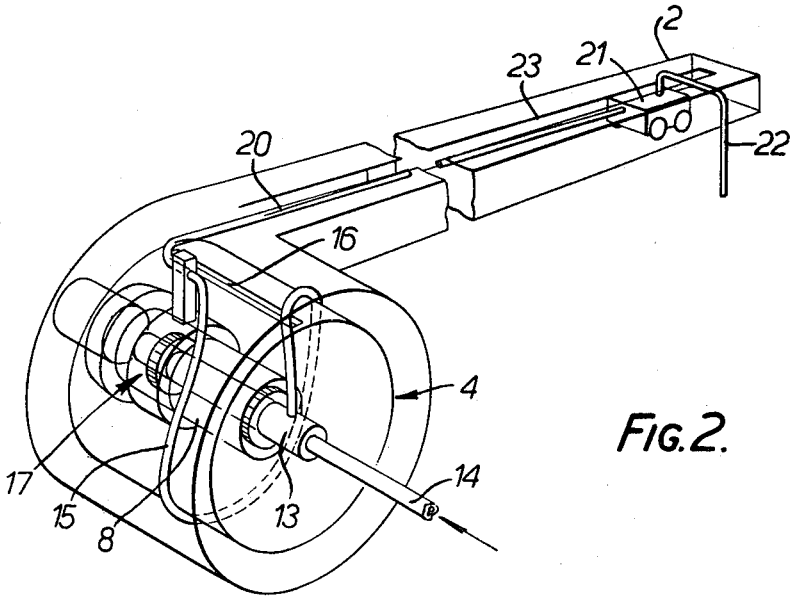
Figure 3:
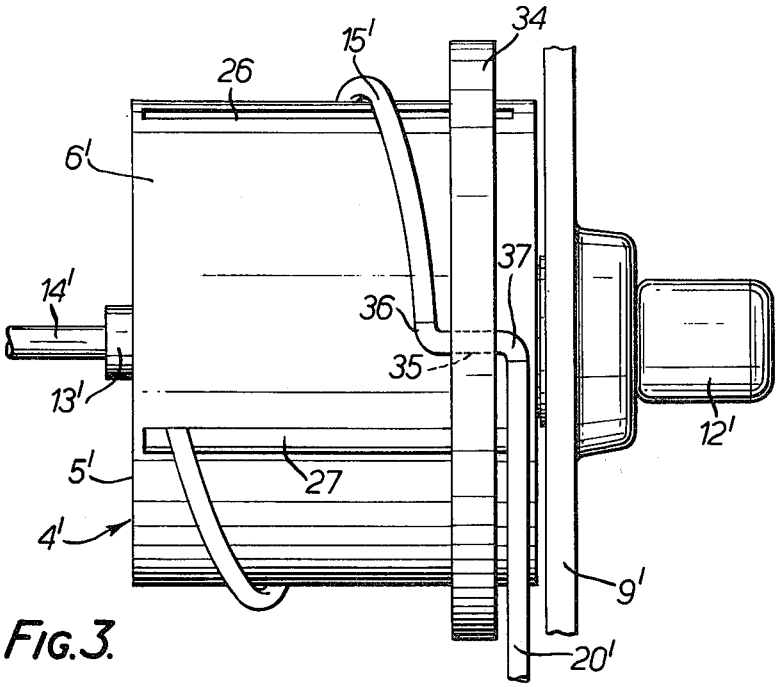
Figure 4:
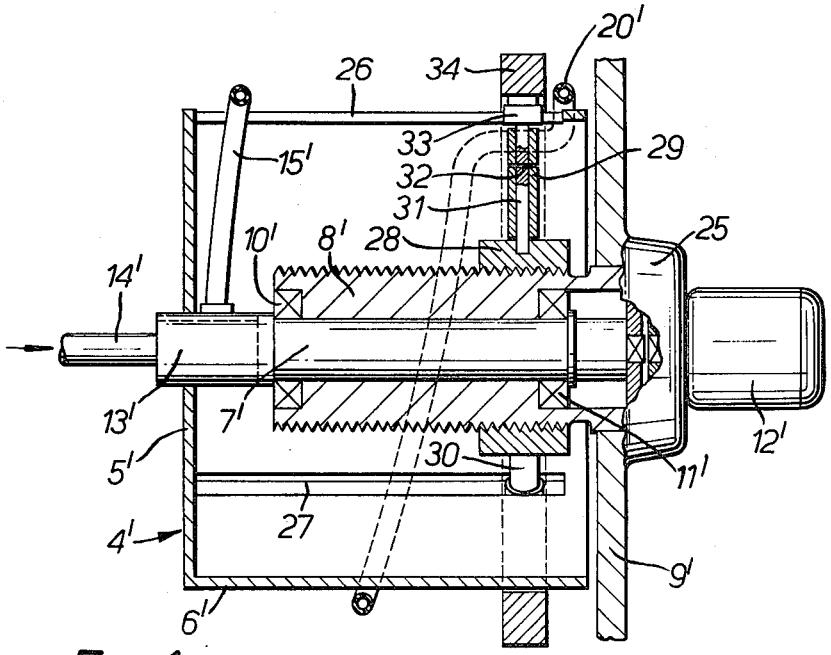

In the accompanying drawings,

FIG. 1 depicts in a purely schematic manner a cut squirt according to the invention, in transparent perspective, FIG. 2 shows the cut squirt of FIG. 1 with its associated hose fully unwound, FIG. 3 shows, in horizontal projection, a drum in a cut squirt according to the invention, and FIG. 4 is a vertical cut through the drum of FIG. 3, with the upper half of the section displaced such that the cut runs through the slot in the casing surface of the drum.

The cut squirt shown in FIGS. 1 and 2 comprises a drum housing 1 and associated boom. The boom 2 extends transversely of the direction of advancement for a paper web 3. The housing 1 and boom 2 are mounted on the paper-making machine in a manner known per se and not illustrated herein.

Inside the drum housing is a hose drum 4, formed in this case as a horizontally-disposed cup-shaped drum having an end wall or bottom 5 and a casing surface 6. Projecting inwardly from the end wall 5 of the drum is a central drum shaft 7 whereby the drum is rotatably supported in a shaft sleeve 8. The shaft sleeve surrounds the drum shaft and is fastened in the end wall 9 of the drum housing. The bearings are marked with shaded lines and are designated 10 and 11, respectively. A motor 12 is mounted on the end wall 9 of the housing and is drive-connected to the drum shaft 7. At the end wall 5 of the drum 4, the drum shaft 7 is provided with a swivel 13 for the supply of cutting liquid, usually, water under pressure. A pressurized water conduit 14 is connected to the swivel 13, and a flexible hose 15 extends radially outwards from the swivel through a longitudinal slot 16 in the drum casing 6. The hose 15 is laid in bights around the drum casing 6 and is connected to a carrier 17. The carrier 17 consists substantially of a nut member 18 which has threaded engagement with the externally-threaded shaft sleeve 8, and a radially extending arm 19 which projects through said longitudinal slot 16 in the drum casing, the slot thus forming a guide for the arm. The hose 15, as can be seen in the drawings, is connected to the carrier member in that section of the arm 19 which is located externally of the drum casing. Here, the hose 15 is connected in a suitable manner to the cutting liquid supply hose 20. This hose is laid in several turns around the drum and then extends outwardly in the hollow boom 2, forward to a carriage 21 from which the jet nozzle 22 extends. The nozzle 22 is in the drawings simply indicated as a pipe which extends downwardly from the carriage in a direction toward the paper web 3, through a longitudinal slot 23 in the boom. The carriage is supported on four wheels.

In FIG. 1, the cutting liquid supply hose 20 is shown as being in four turns around the drum 4, each turn being spaced equidistantly from the next. It is drawn in this manner for the sake of clarity, as in practice the turns of the hose will abut closely, as is usual when a hose is coiled onto a drum.

In FIG. 2, the cut squirt of FIG. 1 is shown with the liquid supply hose 20 fully unwound. The carriage 21 has moved all the way out to the end of the boom 2, thus being located at the far side edge of the paper web (not shown in FIG. 2). As can clearly be seen in FIG. 2, the point of exit for the liquid supply hose 20 relative to the drum is retained during the entire uncoiling process because the nut member 18, to which the hose 20 is connected, has moved longitudinally along the shaft sleeve 8. The thread engagement between the carrier 17, i.e., its nut member 18, and the externally-threaded shaft sleeve 8 is made in such a way that for each revolution of the drum 4, the carrier will move in the axial direction of the drum a distance corresponding to one hose width (hose diameter). When the hose is subsequently to be re-coiled (the motor 12 is reversed), the carrier 17 will move back in a direction toward the swivel 13 and the hose 20 will thus at all times run onto the drum along a path approximately aligned with its course in the boom 2. In length, the flexible hose 15 is dimensioned so as to accomodate to the axial movement of the carrier 17.

The embodiment in FIGS. 3 and 4, where only the drum and associated components are shown, has in principle the same construction as the embodiment shown in FIGS. 1 and 2, but the carrier is formed as a three-armed cross and includes a ring passing around the outside of the drum.

The same reference numbers as in FIGS. 1 and 2 are used to designate corresponding components, but with the addition of an apostrophe.

The drum 4' is also in this embodiment formed with an end wall 5' and a casing surface 6', and the drum has a substantially cup-shaped configuration, as can be seen in the vertical section in FIG. 4. Extending from the end wall 5' of the drum is a drum shaft 7' whereby the drum is rotatably supported by means of bearings 10' and 11' in a shaft sleeve 8' which extends outwardly from a wall 9'. The wall 9' belongs to a drum housing which is not illustrated, but which corresponds to the drum housing 1 in FIGS. 1 and 2. A motor 12' is mounted on the wall 9' and has drive connection with the drum shaft 7' by means of a gear box 25.

The drum casing 6' has three longitudinal slots 26, 27 (only two such slots are illustrated). The slots are equally spaced about the circumference of the drum at angles of 120°. The slots correspond in principle to the slot 16 in FIGS. 1 and 2.

The shaft sleeve 8' as can be seen in the vertical section in FIG. 4, is externally threaded, and a nut member 28 is screwed onto the sleeve 8'. The nut member 28 is provided with three cross-arms, in that three pipes 29, 30 (only two of which are illustrated) are welded to the nut member 28 and project radially outward toward the respective slots 26, 27 in the drum casing. A rod 31 is inserted into each pipe 29, 30 and into a blind bore in the nut member 28, and is secured in each respective pipe by means of a locking pin 32. At the point where the rod 31 passes through the slot 26, a sliding sleeve 33 is mounted on the rod such that the rod has guidance in the slot 26. Externally of the drum casing, the rod 31 is connected to a ring 34 which extends around the drum casing. The ring 34 has an axial throughgoing bore 35 to which two coupling elbows 36, 37 are connected. The hose 20', which leads to the spray nozzle, is connected to the elbow 37, and the flexible hose 15' is connected to the elbow 36. At its other end, the hose 15' is connected to the swivel 13'.

The difference between the two embodiments described hereinabove is merely that the carrier has a different configuration in FIGS. 3 and 4, which provides a more stable construction and better control during the coiling and uncoiling operations.

The embodiment in FIGS. 3 and 4 is considered to be the preferred embodiment example. However, the invention can be modified substantially within the scope of the patent claims, the essential feature being that the carrier moves during the rotation of the drum such that the point at which the hose 20; 20' leaves/enters the drum is retained at approximately the same location, thus avoiding bends in the liquid supply hose 20; 20'. The supply of cutting liquid from the conduit 14; 14' to the carrier and further to the hose 20; 20' can naturally also be modified in different ways, which will be obvious to the skilled practitioner on the basis of the above description of the invention. Thus, the hose 15; 15' does not necessarily have to pass around the exterior of the drum, as bellows connections, telescopic connections, etc., could also be utilized.

The liquid supply hose 20; 20' may with advantage be made of nylon piping, for example, with an external diameter of 22 mm and an internal diameter of 16,5 mm. The hose 15; 15' can be a reinforced hose of PVC with an external diameter of 15.5 mm and an internal diameter of $\frac{3}{8}$ inch. The hose dimensions specified herein are well suited to a drum diameter of about 500 mm and for paper web widths of between 6 and 12 meters.

Having described my invention, I claim:

1. A cut squirt wherein a nozzle for a jet of cutting liquid is movably supported on a boom extending transversely of the direction of advancement for a web of paper and is connected to a supply hose for cutting liquid which is coiled in one layer on a driven drum and is connected at the drum to a feed conduit for said liquid, whereby the nozzle is driven back and forth along the boom when the hose is uncoiled from or coiled onto the drum, characterized in that the drum end of the hose is attached to a carrier which rotates together with the drum and has cam engagement with a fixed guide member such that the carrier is displaced one hose width in the axial direction of the drum for each revolution of the drum, and in that flexible, liquid-conduit connection is arranged between the drum end of the hose and the cutting liquid feed conduit to the drum.

2. A cut squirt according to claim 1, characterized in that the carrier comprises a nut member which has thread engagement with an externally threaded shaft sleeve.

3. A cut squirt according to claim 2, characterized in that the drum shaft is rotatably supported in the shaft sleeve.

4. A cut squirt according to claim 2, characterized in that the carrier comprises three arms which project radially outwards from the nut member, pass through respective axial slots in the drum casing, and support a ring passing around the drum casing, to which ring the drum end of the hose and the flexible, liquid-conduit connection are attached.

5. A cut squirt according to claim 1, characterized in that the flexible, liquid-conduit connection is a flexible hose which projects radially outwards from a swivel connection in the drum shaft to the drum casing and extending along said casing to the drum end of the coilable hose at the carrier.

6. A cut squirt according to claim 5, characterized in that the flexible hose is laid around the drum casing.

* * * * *